United States Patent [19]

Kretschmar

[11] Patent Number: 4,586,302

[45] Date of Patent: May 6, 1986

[54] CONSTRUCTION-TYPE SUPPORT SYSTEM

[75] Inventor: Hans-Georg Kretschmar, Essen, Fed. Rep. of Germany

[73] Assignee: Cube-System Gerustbau GmbH, Essen, Fed. Rep. of Germany

[21] Appl. No.: 539,836

[22] Filed: Oct. 7, 1983

[30] Foreign Application Priority Data

Oct. 9, 1982 [DE] Fed. Rep. of Germany ..... 3237467

[51] Int. Cl.[4] ..... E04H 12/08

[52] U.S. Cl. ..... 52/173 R; 52/303; 52/300; 52/593

[58] Field of Search ..... 52/589, 591, 594, 300, 52/570, 303, 607, 173, 700, 704, 480, 593; 98/31, 32

[56] References Cited

U.S. PATENT DOCUMENTS

| | | | |
|---|---|---|---|
| 1,744,185 | 1/1930 | Waite et al. | 52/303 |
| 1,944,787 | 1/1934 | Dusablon | 52/370 |
| 2,173,020 | 9/1939 | Kubach | 52/589 |
| 2,227,713 | 1/1941 | Higgins | 52/370 |
| 2,532,006 | 11/1950 | Beach | 52/173 |
| 2,861,388 | 11/1958 | Favaretto | 52/594 |
| 3,180,060 | 4/1965 | Persak | 52/591 |
| 3,333,388 | 8/1967 | Sandin | 52/300 |

FOREIGN PATENT DOCUMENTS

| | | | |
|---|---|---|---|
| 362371 | 12/1931 | United Kingdom | 52/594 |

*Primary Examiner*—James L. Ridgill, Jr.

*Attorney, Agent, or Firm*—Karl F. Ross; Herbert Dubno

[57] ABSTRACT

A construction-type support system comprises a plurality of at least generally parallelopipedal blocks each having top and bottom walls formed with complementary vertical projections and recesses. These blocks fit together with the projections interengaged and preventing relative horizontal shifting. The blocks are all of the same height and depth, but are of a width that is a whole-number multiple of a predetermined width. Thus normally some of the blocks are substantially cubical and the others are rectangular and twice the width as the cubical blocks. The top and bottom walls of the rectangular blocks each have two such respective projections and recesses. When fitted together and stood on a flat surface, a system of such blocks is extremely stable. They can be stacked up in a pyramid or tower, or can form a wall.

10 Claims, 6 Drawing Figures

CONSTRUCTION-TYPE SUPPORT SYSTEM

FIELD OF THE INVENTION

The present invention relates to a support system for use in construction. More particularly this invention concerns a heavy-duty system used in the erecting or demolishing of large structures.

BACKGROUND OF THE INVENTION

In the erecting and demolishing of large structures, such as outdoor concrete bridges, it is necessary to erect a heavy-duty support system that can hold up the structure either as it is being assembled or erected, or as it is being taken apart. This support structure must therefore be capable of holding up very great masses, and must hold them stably. At the same time it must be relatively easy to assemble and dissassemble it so that excessive job time is not lost.

The standard system according to DIN 4411 comprises steel-tube posts, steel lattice elements, and steel stands or trestles that are interconnected together by clips or pins to a rugged assembly. Erecting such a support system is an extremely difficult and onerous job, as is taking it down. In addition the various parts of this system are a problem to keep track of when not assembled together. As a result construction, which term here includes the erection and demolition of a structure, with such an arrangement is very expensive, due mainly to the setup and takedown times.

OBJECTS OF THE INVENTION

It is therefore an object of the present invention to provide an improved construction-type support system.

Another object is the provision of such a construction-type support system which overcomes the above-given disadvantages, that is which serves for the temporary support of very large and heavy objects during construction on them.

A further object is to provide such a support system which can be speedily erected, for instance under a prestressed concrete bridge that is being demolished, and speedily taken down once the job is done.

SUMMARY OF THE INVENTION

A construction-type support system according to this invention comprises a plurality of at least generally parallelopipedal blocks each having top and bottom walls formed with complementary vertical projections and recesses. These blocks fit together with the projections interengaged and preventing relative horizontal shifting.

The blocks according to this invention are all invariably of the same height and depth, but are of a width that is a whole-number multiple of a predetermined width. Thus normally some of the blocks are substantially cubical and the others are rectangular and twice the width as the cubical blocks. The top and bottom walls of the rectangular blocks each have two such respective projections and recesses. When fitted together and stood on a flat surface, a system of such blocks is extremely stable. They can be stacked up in a pyramid or tower, or can form a wall.

The blocks may be made of any relatively strong and incompressible building material. Concrete reinforced with glass fibers is possible, as is use of a fiber-reinforced synthetic resin. The walls of the blocks may be made of sheet light metal or steel.

According to another feature of this invention the recesses and projections are of generally square shape. In addition the top, bottom, and side walls are formed with central throughgoing holes. These holes are of a diameter equal generally to more than half the block thickness. Thus they greatly reduce the mass of the blocks without substantially reducing their strength.

The support system according to this invention can also include respective platforms atop the top walls of some of the blocks, normally the top blocks or row of blocks, and respective jacks in the blocks underneath the platforms that are vertically extensible to lift the platforms from the respective blocks. This makes it possible to lift up the platforms to assume a load, as when an overhead structure must be supported as it is dismantled, or to lift the supported object up to the desired position.

These jacks each have a base that complementarily fits with the bottom wall of the respective block, that is they fit with the bottom formation and/or hole.

In case the load or object being supported is not level the platform can pivot limitedly about at least one axis relative to the respective jack, normally about two generally perpendicular axes.

The platform itself may be constructed and adapted to support a load, and may even serve as a platform on which workers can stand and erect or demolish something.

The support system according to this invention can be assembled very easily, and can be taken apart with similar ease. It has virtually no moving parts, but merely needs to be stacked up, so even unskilled laborers can erect a very stable and strong support system.

DESCRIPTION OF THE DRAWING

The above and other features and advantages will become more readily apparent from the following, reference being made to the accompanying drawing in which.

SPECIFIC DESCRIPTION

Figure 6:
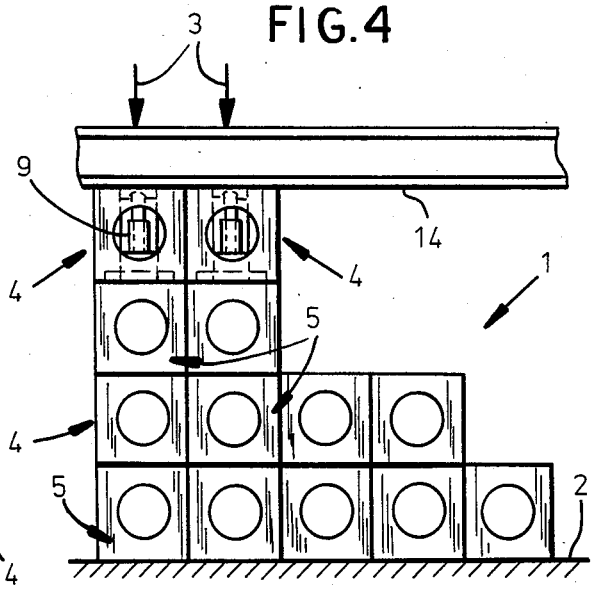
FIG. 6 is a small-scale view of the sytsem according to this invention in use.

As seen in FIG. 6 a support system 1 according to this invention stands on a solid base or footing 2 and is constituted by identical blocks 4 and 5. The blocks 4 are all identical and each block 5 is of the same shape as two adjacent blocks 4. The double blocks 5 may be lapped horizontally like standard bricks. The system 1 is intended to support a vertical load such as indicated at 3.

Figure 1:
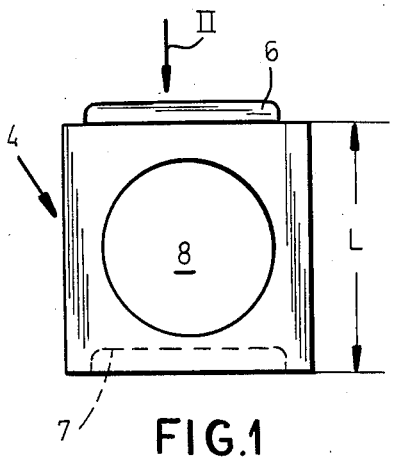
FIG. 1 is a side view of a block for a system according to this invention.
Figure 2:
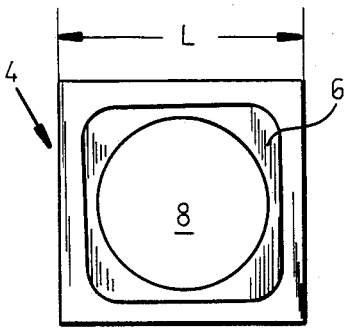
FIG. 2 is a top view taken in the direction of arrow II of FIG. 1.

FIGS. 1 and 2 shows how each block 4 is cubical, having a uniform height, width, and depth dimension L Projecting upward from the top surface of the block 4 is a square projection 5 with rounded corners and sides running parallel to the respective vertical sides of the block 4. The bottom surface of each block 4 is formed with a square recess 7 perfectly complementary to the respective projection or bump 6. In addition every wall — top, bottom, and side — of the cube or block 4 is formed with a central circular hole 8 having a diameter slightly greater than L/2. These holes 8 serve to reduce the weight of the cubes 4 without substantially weakening them.

Each such block 4 is formed of light sheet metal, the sides being identical square plates welded together along vertical lines, and the top and bottom walls being substantially identical and being welded to the top and bottom edges of the side walls. A side length L of between 50 cm and 100 cm is typical. Such a structure is extremely solid, using sheet steel it is possible to support a 20 ton load on blocks 4 that are 60 cm on a side. When stacked atop each other the resultant system is very stable and capable of supporting enormous weights.

Figure 3:
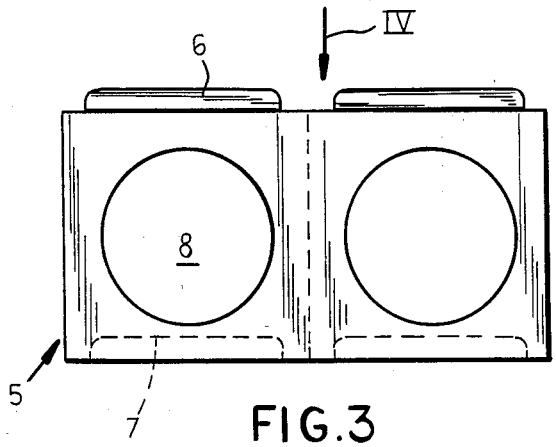
FIG. 3 is a side view of a double block of a system according to the invention.
Figure 4:
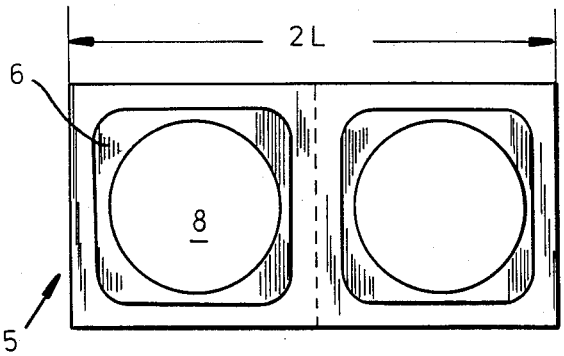
FIG. 4 is a top view taken in the direction of arrow IV of FIG. 3.

FIGS. 3 and 4 illustrate a double block 5 formed exactly as two side-by-side but inseparably joined blocks 4. The block 5 therefore has an overall length 2L, and its top wall has two bumps 6 and holes 8 and its bottom wall two recesses 7. This bricklike construction allows the blocks 5 to be lapped in the system 1 to couple the system together longitudinally also.

Figure 5:
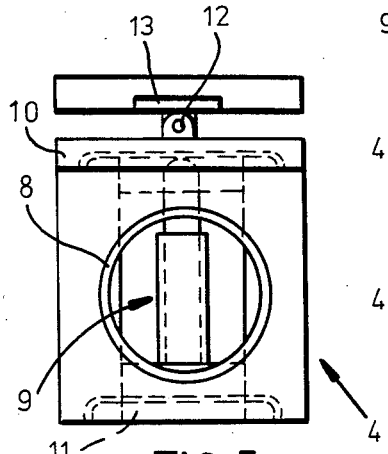
FIG. 5 is a side view of a block equipped with a raisable top according to this invention.

As also shown in FIGS. 5 and 6 it is possible to equip each block 4 or 5 internally with a vertically extensible hydraulic jack 9 having a raisable platform 10 that can fit snugly down over the respective bump 6 and that is hinged about horizontal and perpendicular pivots 12 and 13 on the jack 9. The jack 9 further has a lower end or foot 11 that fits complementarily into the lower recess 7 and/or hole 8. These platforms 10 can serve directly as the working platform on which the operators stand. They may also be pushed up under a load such as a beam 14, the pivots 12 and 13 permitting limited tipping of the platforms 10 to compensate for inclined loads 3.

The system according to this invention can be assembled and disassembled very easily. Once under load it will be extremely stable, providing a very solid base for whatever it is supporting. Due to the basically one-piece construction of the arrangement, parts of it cannot get lost. The blocks can be made of weather-resistant materials, so that they can even be applied to emergency use in propping up failing structures, or during long construction/restoration projects.

I claim:

1. A construction-type support system comprising:

a plurality of at least generally parallelopipedal blocks each having top and bottom walls formed respectively with complementary vertical and generally square projections and recesses and substantially flat and planar side walls, the blocks fitting together with the projections interengaged and preventing relative horizontal shifting, the walls all being formed of sheet steel and each being formed with a central circular hole, the holes all being identical and of smaller cross section than the projections and recesses.

2. The construction-type support system defined in claim 1 wherein the blocks are all of identical height and width and are a width that is a whole-number multiple of a predetermined width.

3. The construction-type support system defined in claim 2 wherein the holes are of a diameter equal generally to more than half the block thickness.

4. The construction-type support system defined in claim 2 wherein some of the blocks are substantially cubical and the others are rectangular and twice the width as the cubical blocks.

5. The construction-type support system defined in claim 4 wherein the top and bottom walls of the rectangular blocks each have two such respective projections and recesses.

6. A construction-type support system comprising:

a plurality of at least generally parallelopipedal blocks each having top and bottom walls formed respectively with complementary vertical and generally square projections and recesses and substantially flat and planar side walls, the blocks fitting together with the projections interengaged and preventing relative horizontal shifting, the walls all being formed of sheet steel and each being formed with a central circular hole, the holes all being identical and of smaller cross section than the projections and recesses;

respective platforms atop the top walls of some of the blocks; and respective jacks in the blocks underneath the platforms that are vertically extensible to lift the platforms from the respective blocks.

7. The construction-type support system defined in claim 6 wherein the jacks each have a base that complementarily fits with the bottom wall of the respective block.

8. The construction-type support system defined in claim 6 wherein the platform can pivot limitedly about at least one axis relative to the respective jack.

9. The construction-type support system defined in claim 6 wherein the platform can pivot limitedly about two generally perpendicular axes relative to the respective jack.

10. The construction-type support system defined in claim 6 wherein the platform is constructed and adapted to support a load.

* * * * *